US006591453B2

(12) United States Patent
Jenks

(10) Patent No.: US 6,591,453 B2
(45) Date of Patent: Jul. 15, 2003

(54) LOCKING HINGE SYSTEM

(76) Inventor: John E. Jenks, 245 Gulf Terrace Dr., Destin, FL (US) 32541

( * ) Notice: Subject to any disclaimer, the term of this patent is extended or adjusted under 35 U.S.C. 154(b) by 0 days.

(21) Appl. No.: 09/954,289

(22) Filed: Sep. 14, 2001

(65) Prior Publication Data

US 2003/0051314 A1 Mar. 20, 2003

(51) Int. Cl.[7] ..... E05D 11/10

(52) U.S. Cl. ..... 16/353; 16/348; 16/329; 292/DIG. 17; 292/298

(58) Field of Search ..... 16/348, 353, 522, 16/229, 324, 329, 49, 50; 292/DIG. 17, 292, 288, 289, 298

(56) References Cited

U.S. PATENT DOCUMENTS

| | | | | | |
|---|---|---|---|---|---|
| 294,746 | A | * | 3/1884 | Morgenstern | 16/330 |
| 485,613 | A | | 11/1892 | Deane | |
| 853,507 | A | | 5/1907 | Fielding | |
| 1,212,475 | A | * | 1/1917 | Gillies | 16/329 |
| 1,265,363 | A | | 5/1918 | Nixon | |
| 1,868,342 | A | | 7/1932 | Yurkovitch | |
| 2,462,268 | A | * | 2/1949 | Kahl | 114/221 R |
| 3,048,883 | A | * | 8/1962 | Rizzuto | 16/353 |
| 3,579,712 | A | | 5/1971 | Smith | |
| 3,744,085 | A | | 7/1973 | Griego | |
| 3,769,928 | A | * | 11/1973 | Kahl | 114/221 R |
| 3,874,029 | A | | 4/1975 | McCullough | |
| 4,564,974 | A | * | 1/1986 | McGrail et al. | 16/349 |
| 4,658,447 | A | * | 4/1987 | Smith | 16/329 |
| 4,666,327 | A | * | 5/1987 | Su | 16/324 |
| 4,747,280 | A | * | 5/1988 | Shaw | 211/64 |
| 5,533,234 | A | * | 7/1996 | Bizek | 16/277 |
| 5,765,263 | A | | 6/1998 | Bolinas | |
| 5,887,317 | A | | 3/1999 | Baker | |
| 6,317,928 | B1 | * | 11/2001 | Guillemette | 16/353 |

* cited by examiner

*Primary Examiner*—Gary Estremsky
*Assistant Examiner*—Mark Williams

(57) ABSTRACT

A locking hinge system for allowing an individual to selectively lock a door within a desired open or closed position. The locking hinge system includes a first leaf having a plurality of first extensions and first apertures, a second leaf having a plurality of second extensions and second apertures, a tubular pin pivotally attaching the leafs together, and a locking pin for locking the leafs in a desired open or closed position. The locking pin is preferably stored within the lumen of the tubular pin and then removed for insertion into the apertures within the extensions for locking the leafs into the desired position. The first leaf may be attached to a door and the second leaf may be attached to a doorjamb or vice versa. In an alternative embodiment, a locking mechanism that is accessible from outside of the door is utilized to manipulate the locking pin within the apertures of the extensions.

13 Claims, 13 Drawing Sheets

LOCKING HINGE SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to door hinges and more specifically it relates to a locking hinge system for allowing an individual to selectively lock a door within a desired open or closed position.

2. Description of the Prior Art

Door hinges have been in use for years. A conventional door hinge is comprised of a pair of leafs pivotally attached to one another by a pin member extending through a plurality of extended tubular members. The main problem with conventional door hinges is that they do not allow an individual to lock the door into desired open and closed positions. A further problem with conventional door hinges is that they do not allow for the securing of a door position at the inner portion of the door. Conventional door hinges require the usage of additional lock devices to lock a door in a closed position. In addition, conventional door hinges require the usage of a "door stop" to keep a door in a desired open position.

Examples of patented devices which are related to the present invention include U.S. Pat. No. 853,507 to Fielding; U.S. Pat. No. 1,265,363 to Nixon; U.S. Pat. No. 3,579,712 to Smith; U.S. Pat. No. 4,564,974 to McGrail; U.S. Pat. No. 5,765,263 to Bolinas; U.S. Pat. No. 5,887,317 to Baker; U.S. Pat. No. 3,874,029 to McCullough; U.S. Pat. No. 3,744,085 to Griego; U.S. Pat. No. 1,868,342 to Yurkovitch; U.S. Pat. No. 485,613 to Deane; U.S. Pat. No. 4,658,447 to Smith.

While these devices may be suitable for the particular purpose to which they address, they are not as suitable for allowing an individual to selectively lock a door within a desired open or closed position. Conventional door hinges do not allow for the selective locking of a position of a door.

In these respects, the locking hinge system according to the present invention substantially departs from the conventional concepts and designs of the prior art, and in so doing provides an apparatus primarily developed for the purpose of allowing an individual to selectively lock a door within a desired open or closed position.

SUMMARY OF THE INVENTION

In view of the foregoing disadvantages inherent in the known types of door hinges now present in the prior art, the present invention provides a new locking hinge system construction wherein the same can be utilized for allowing an individual to selectively lock a door within a desired open or closed position.

The general purpose of the present invention, which will be described subsequently in greater detail, is to provide a new locking hinge system that has many of the advantages of the door hinges mentioned heretofore and many novel features that result in a new locking hinge system which is not anticipated, rendered obvious, suggested, or even implied by any of the prior art door hinges, either alone or in any combination thereof.

To attain this, the present invention generally comprises a first leaf having a plurality of first extensions and first apertures, a second leaf having a plurality of second extensions and second apertures, a tubular pin pivotally attaching the leafs together, and a locking pin for locking the leafs in a desired open or closed position. The locking pin is preferably stored within the lumen of the tubular pin and then removed for insertion into the apertures within the extensions for locking the leafs into the desired position. The first leaf may be attached to a door and the second leaf may be attached to a doorjamb or vice versa. In an alternative embodiment, a locking mechanism that is accessible from outside of the door is utilized to manipulate the locking pin within the apertures of the extensions.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a locking hinge system that will overcome the shortcomings of the prior art devices.

A second object is to provide a locking hinge system for allowing an individual to selectively lock a door within a desired open or closed position.

Another object is to provide a locking hinge system that does not require the usage of a door stop to stop the opening of a door.

A further object is to provide a locking hinge system that does not require the usage of an object such as a door wedge to maintain a door within an open position.

An additional object is to provide a locking hinge system that allows for the locking a door within approximately 90 degrees and 180 degrees open positions.

A further object is to provide a locking hinge system that increases the security of a door in a closed locked position.

Another object is to provide a locking hinge system that allows for the locking of a door at the point of pivotal movement.

A further object is to provide a locking hinge system that allows for the locking of the hinge from outside of a door.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
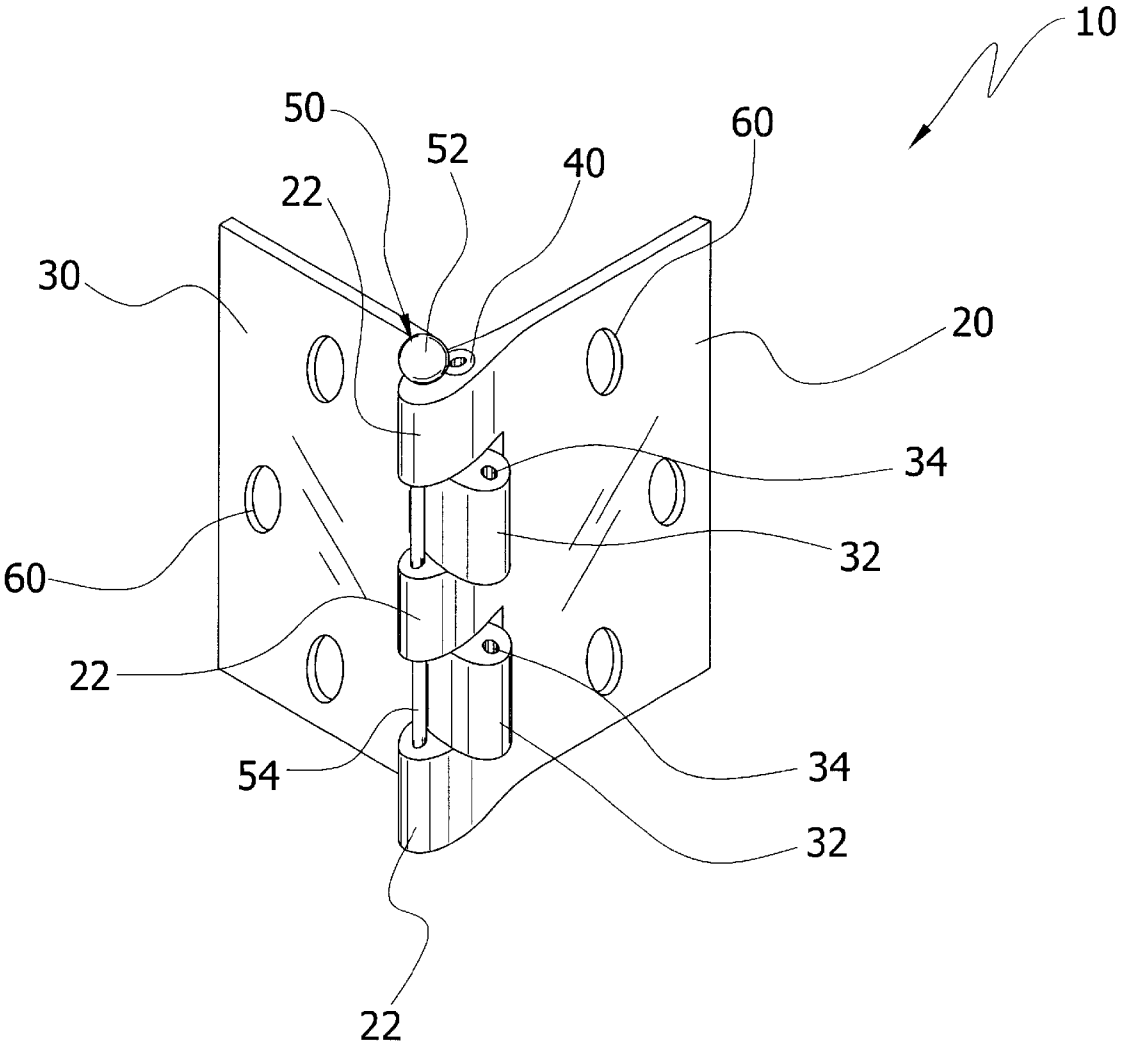
FIG. 1 is an upper perspective view of the present invention in a locked open position.

Turning now descriptively to the drawings, in which similar reference characters denote similar elements throughout the several views, FIGS. 1 through 13 illustrate a locking hinge system 10, which comprises a first leaf 20 having a plurality of first extensions 22 and first apertures 24, a second leaf 30 having a plurality of second extensions 32 and second apertures 34, a tubular pin 40 pivotally attaching the leafs together, and a locking pin 50 for locking the leafs in a desired open or closed position. The locking pin 50 is preferably stored within the lumen of the tubular pin 40 and then removed for insertion into the apertures 24, 34 within the extensions for locking the leafs into the desired position. The first leaf 20 may be attached to a door 12 and the second leaf 30 may be attached to a doorjamb or vice versa. In an alternative embodiment, a locking mechanism 70 that is accessible from outside of the door 12 is utilized to manipulate the locking pin 50 within the apertures of the extensions.

Figure 2:
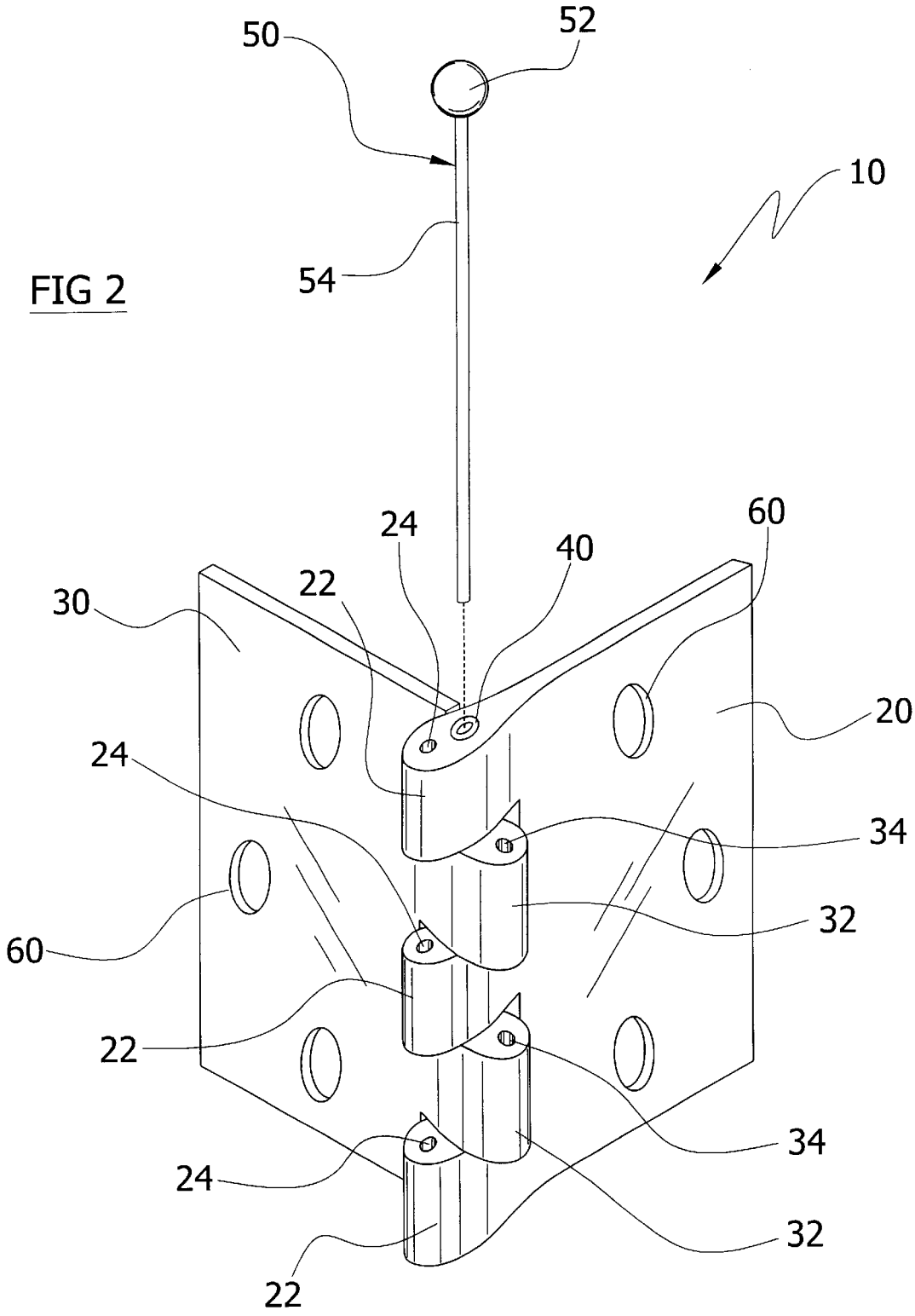
FIG. 2 is an exploded upper perspective view of the present invention in the open position.
Figure 3:
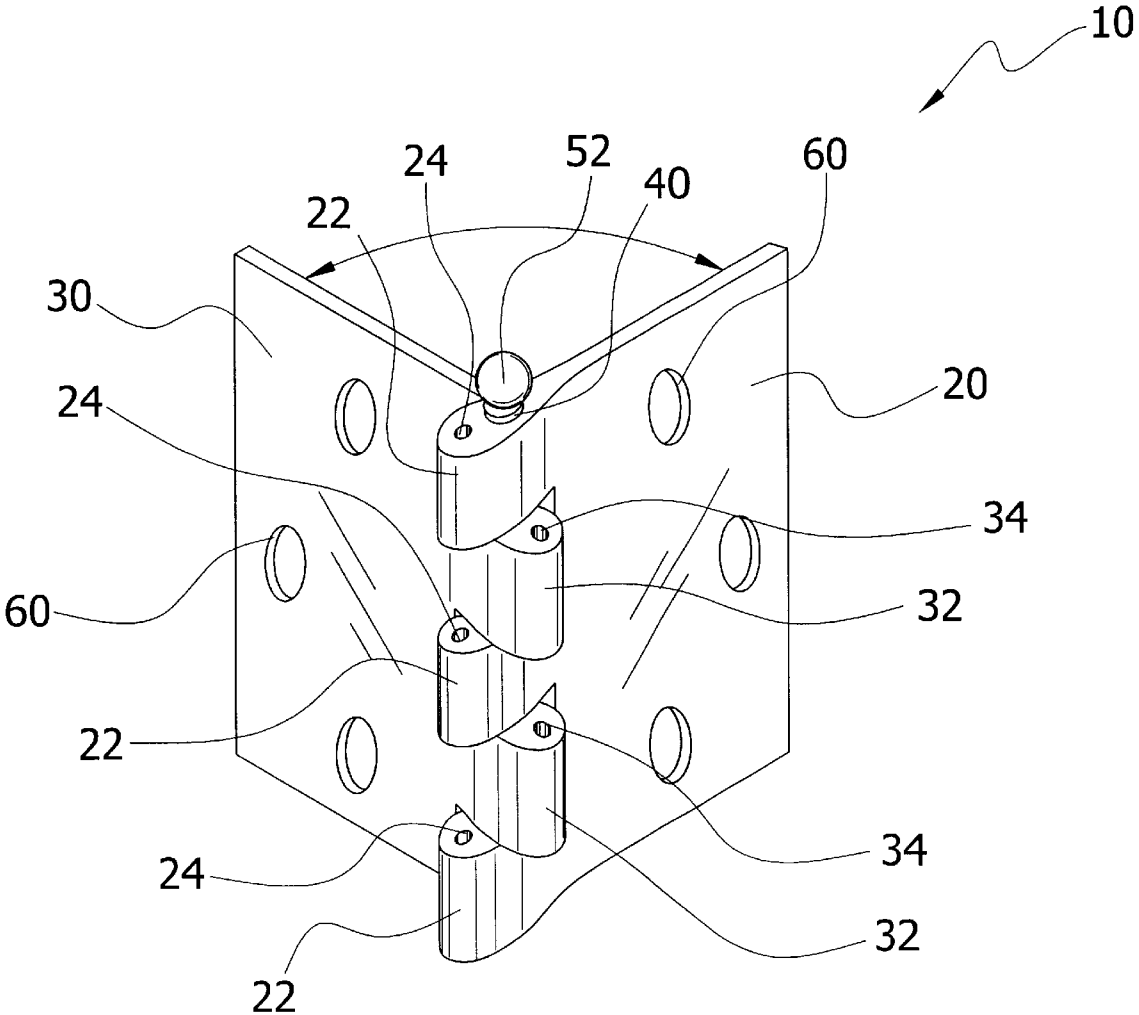
FIG. 3 is an upper perspective view of the present invention in the open position.

As shown in FIGS. 1 through 3 of the drawings, the first leaf 20 and the second leaf 30 preferably have a flat structure. The leafs 20, 30 may be formed into various shapes other than the rectangular shape illustrated within the figures. The leafs 20, 30 may also be constructed of various types of materials including but not limited to metal.

As shown in FIGS. 1 through 3 of the drawings, the leafs 20, 30 each preferably include a plurality of securing apertures 60 for allowing securing to an inner edge of a door 12 and the doorjamb by conventional fasteners. Various other fastening systems may be utilized to secure the leafs 20, 30 to the door 12 and doorjamb.

Figure 5:
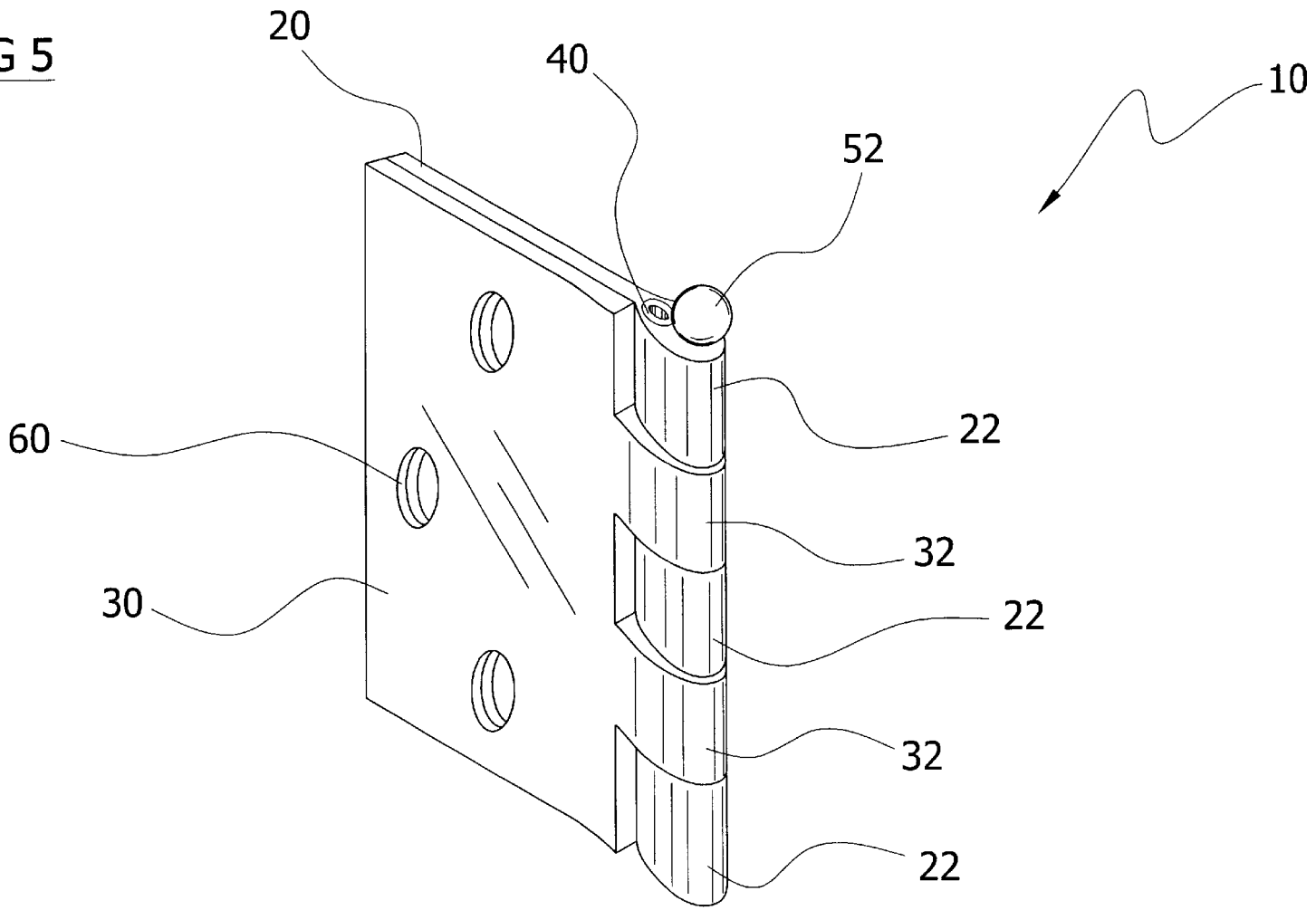
FIG. 5 is an upper perspective view of the present invention in a locked closed position.
Figure 6:
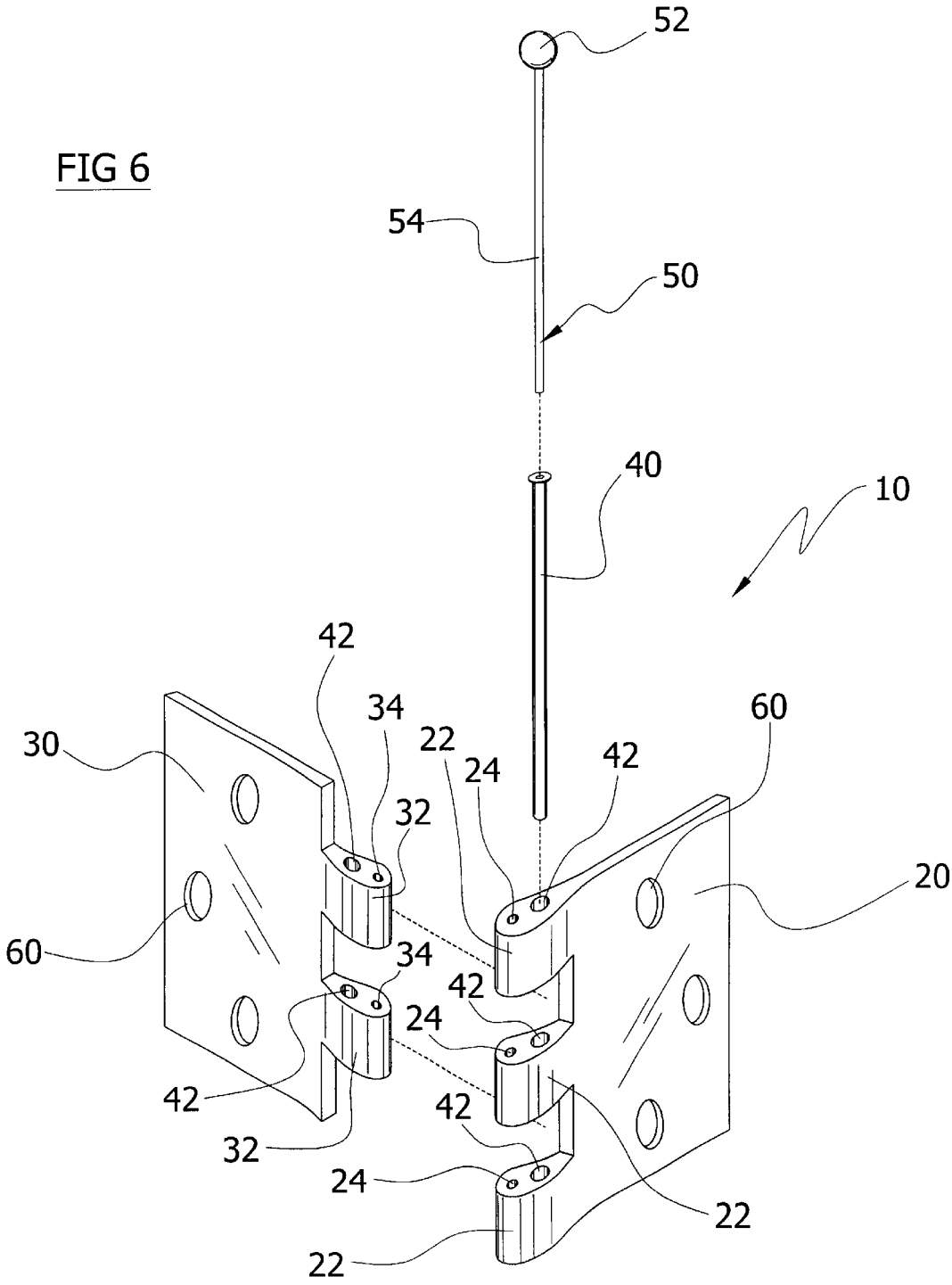
FIG. 6 is an exploded upper perspective view of the present invention.
Figure 7:
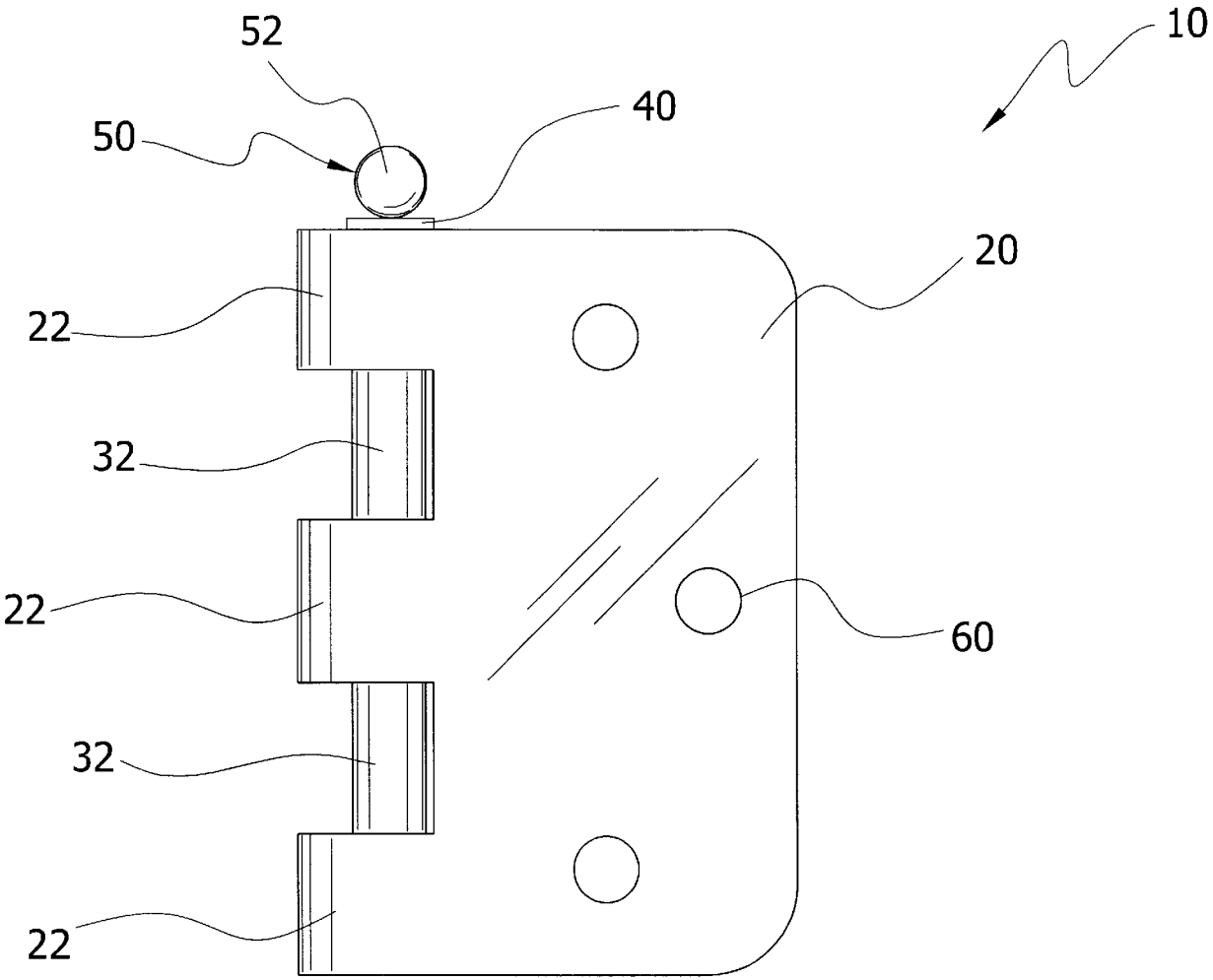
FIG. 7 is a side view of the present invention in the open position.

As best illustrated in FIG. 6 of the drawings, the first leaf 20 includes a plurality of first extensions 22 and the second leaf 30 includes a plurality of second extensions 32. The extensions 22, 32 are preferably staggered with respect to one another for creating a hinge within a center aperture 42. The extensions 22, 32 of the leafs 20, 30 extend substantially along a common plane as best illustrated in FIGS. 1 through 6 of the drawings.

Figure 4:
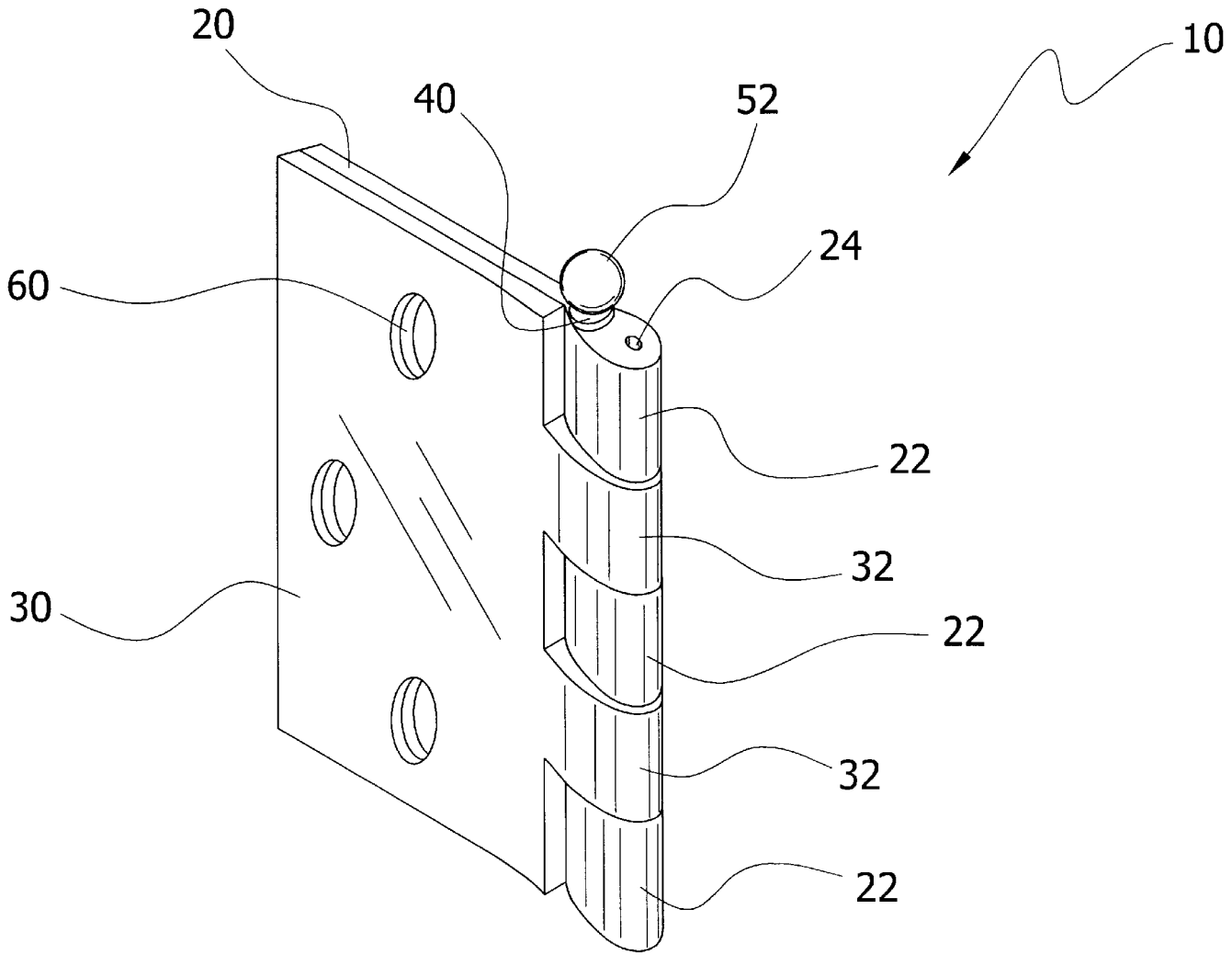
FIG. 4 is an upper perspective view of the present invention in a closed position.

When the leafs 20, 30 are closed with respect to one another, the extensions 22, 32 are substantially vertically aligned with one another as illustrated in FIGS. 4 and 5 of the drawings. When the leafs 20, 30 are approximately 90 degrees with respect to one another in the open position, the extensions 22, 32 are also approximately 90 degrees with respect to one another as shown in FIGS. 1 through 3 of the drawings. The locking pin 50 may be inserted to prevent the door 12 from rotating past 90 degrees and for preventing the door 12 from closing. However, the extensions 22, 32 attached to the leaf 20, 30 connected to the door 12 will typically engage the opposing leaf 20, 30 thereby preventing the door 12 from extending past 90 degrees eliminating the need for a door 12 stop or the like.

The tubular pin 40 extends through the center aperture 42 within the extensions 22, 32 as illustrated in FIG. 6. The leafs 20, 30 pivot about the tubular pin 40 which has a central lumen within for removably receiving and dispensing the locking pin 50. The upper end of the tubular pin 40 is preferably flanged for preventing the tubular pin 40 from passing through the center aperture 42 during operation of the locking hinge system 10.

As further shown in FIG. 6 of the drawings, a plurality of first apertures 24 extend through corresponding first extensions 22 and a plurality of second apertures 34 extend through corresponding second extensions 32. The apertures 24, 34 are formed for removably receiving the shaft 54 of the locking pin 50 thereby allowing for selecting locking of the locking hinge system 10. When the leafs 20, 30 are in the closed position, the apertures 24, 34 are substantially aligned with one another for receiving the locking pin 50 as shown in FIG. 5 of the drawings. When the leafs 20, 30 are pivoted into an open position with respect to one another, the apertures 24, 34 are no longer aligned and the user is able to position the locking pin 50 into a specific set of apertures 24, 34 for retaining the door 12 into an open position as shown in FIG. 1 of the drawings.

As best shown in FIG. 6 of the drawings, the locking pin 50 is preferably comprised of an elongate shaft 54 and a head 52 attached to a distal end thereof. The head 52 may be comprised of various shapes and structures. The shaft 54 preferably has a length sufficient to extend through all of the extensions 22, 32 of the leafs 20, 30. The distal end of the shaft 54 opposite of the head 52 may be blunt or pointed. The locking pin 50 may be comprised of various types of materials such as but not limited to metal. A length of chain or cord may also be utilized for preventing the loss of the locking pin 50 during usage thereof wherein the chain or cord is attached to one of the leafs 20, 30 and the locking pin 50 in an opposing manner.

Figure 8:
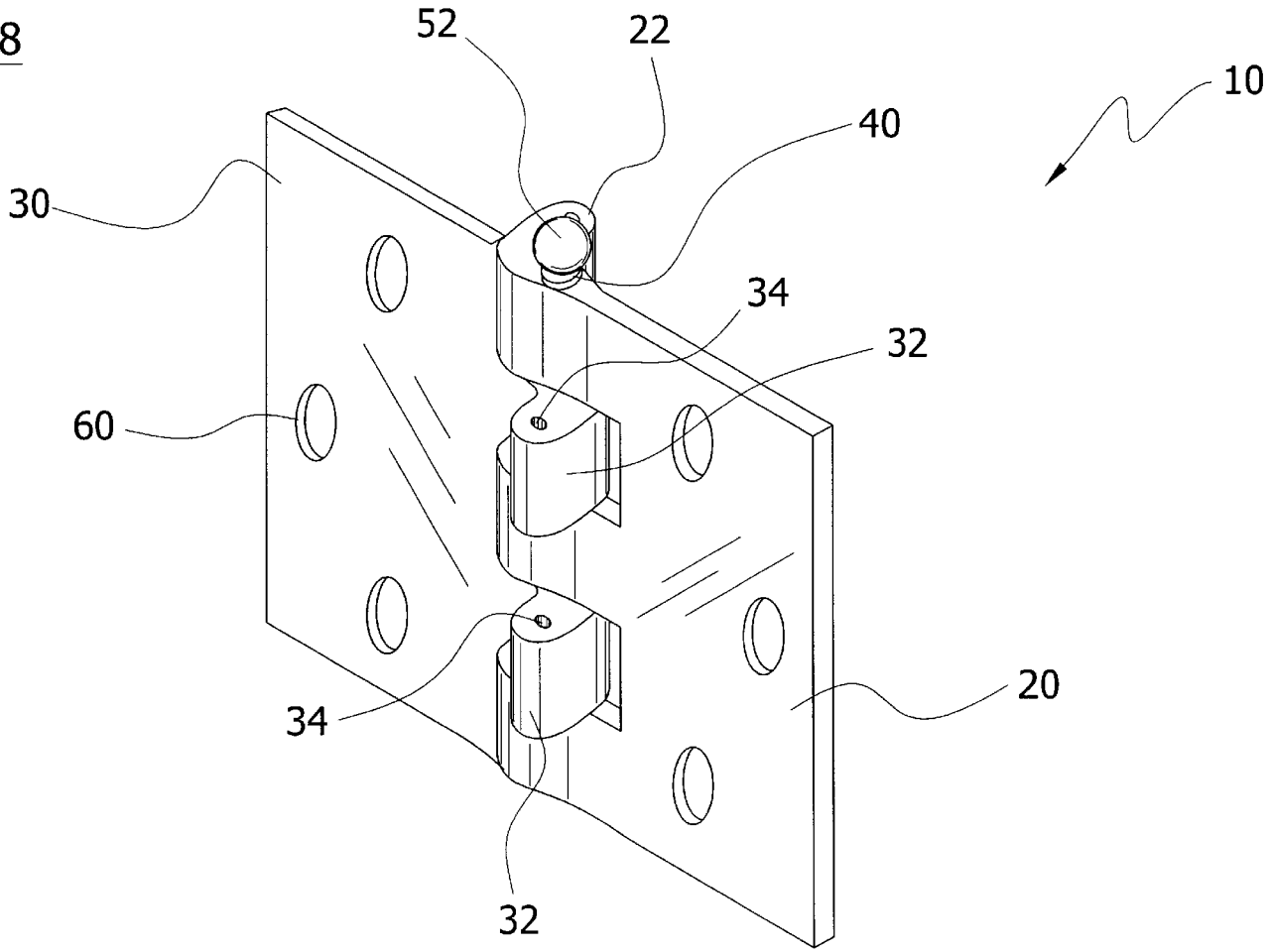
FIG. 8 is an upper perspective view of an alternative embodiment of the present invention opened into a 180 degree open position.
Figure 9:
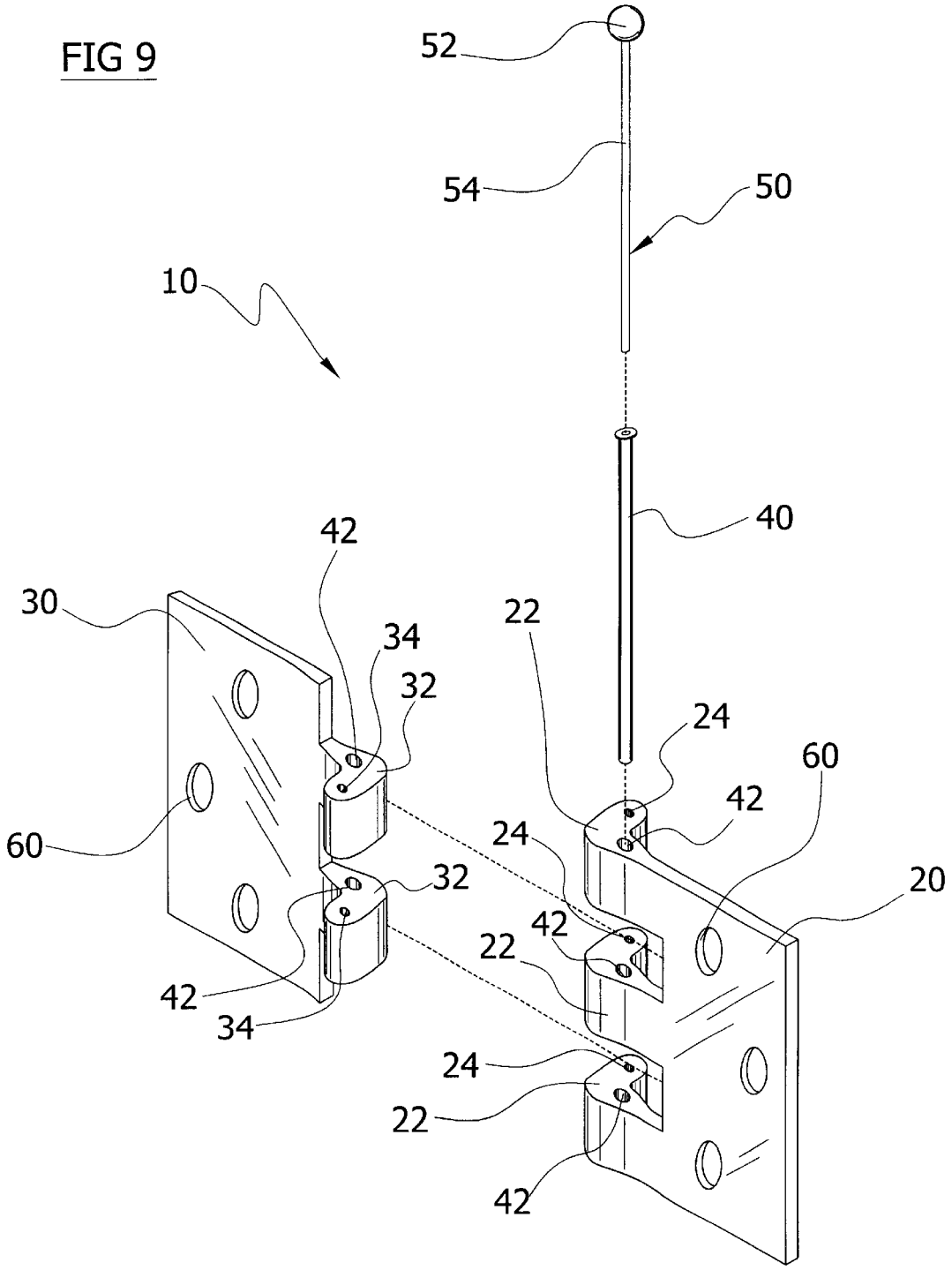
FIG. 9 is an exploded upper perspective view of the alternative embodiment of the present invention.
Figure 10:
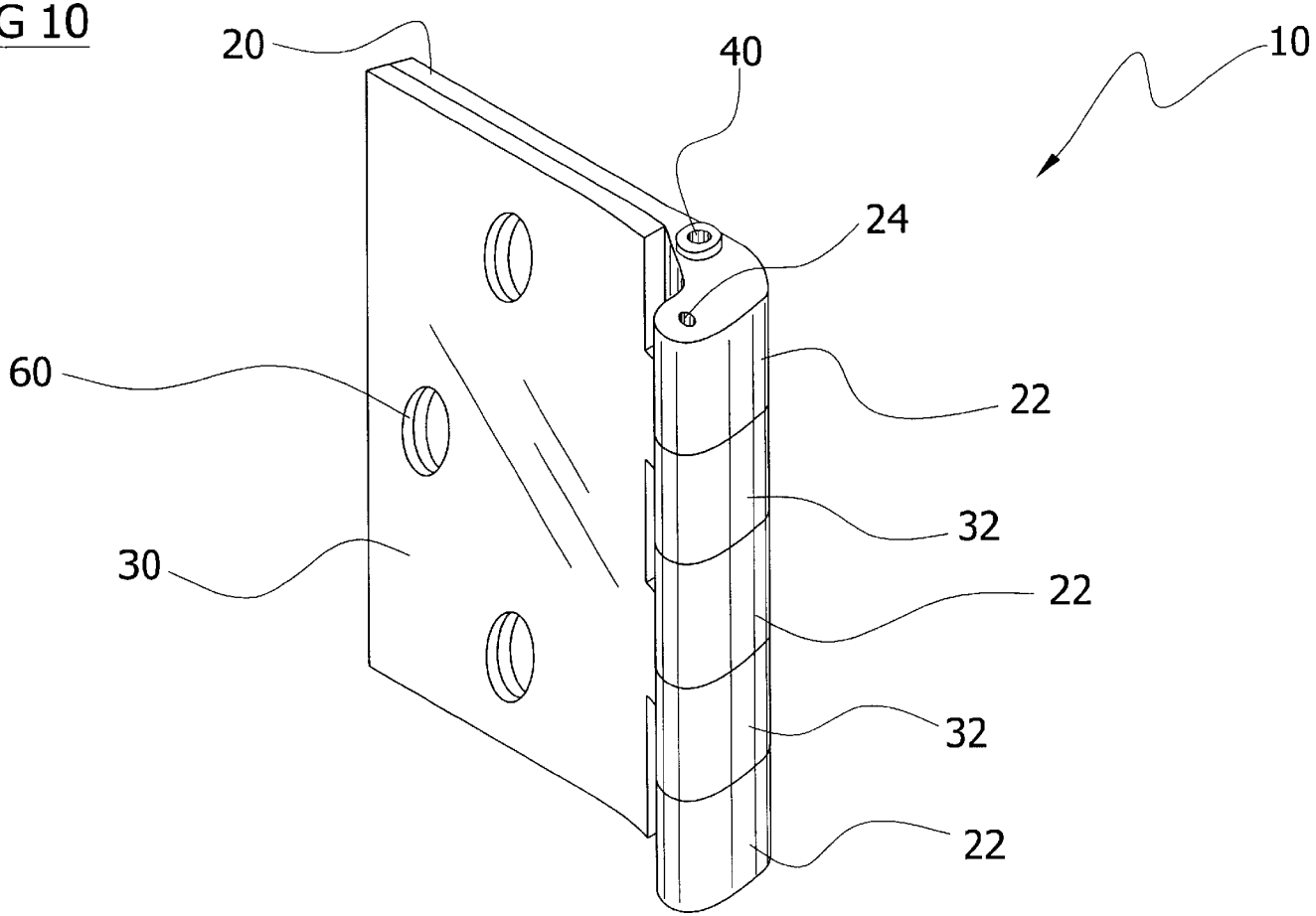
FIG. 10 is an upper perspective view of the alternative embodiment in the closed position.
Figure 11:
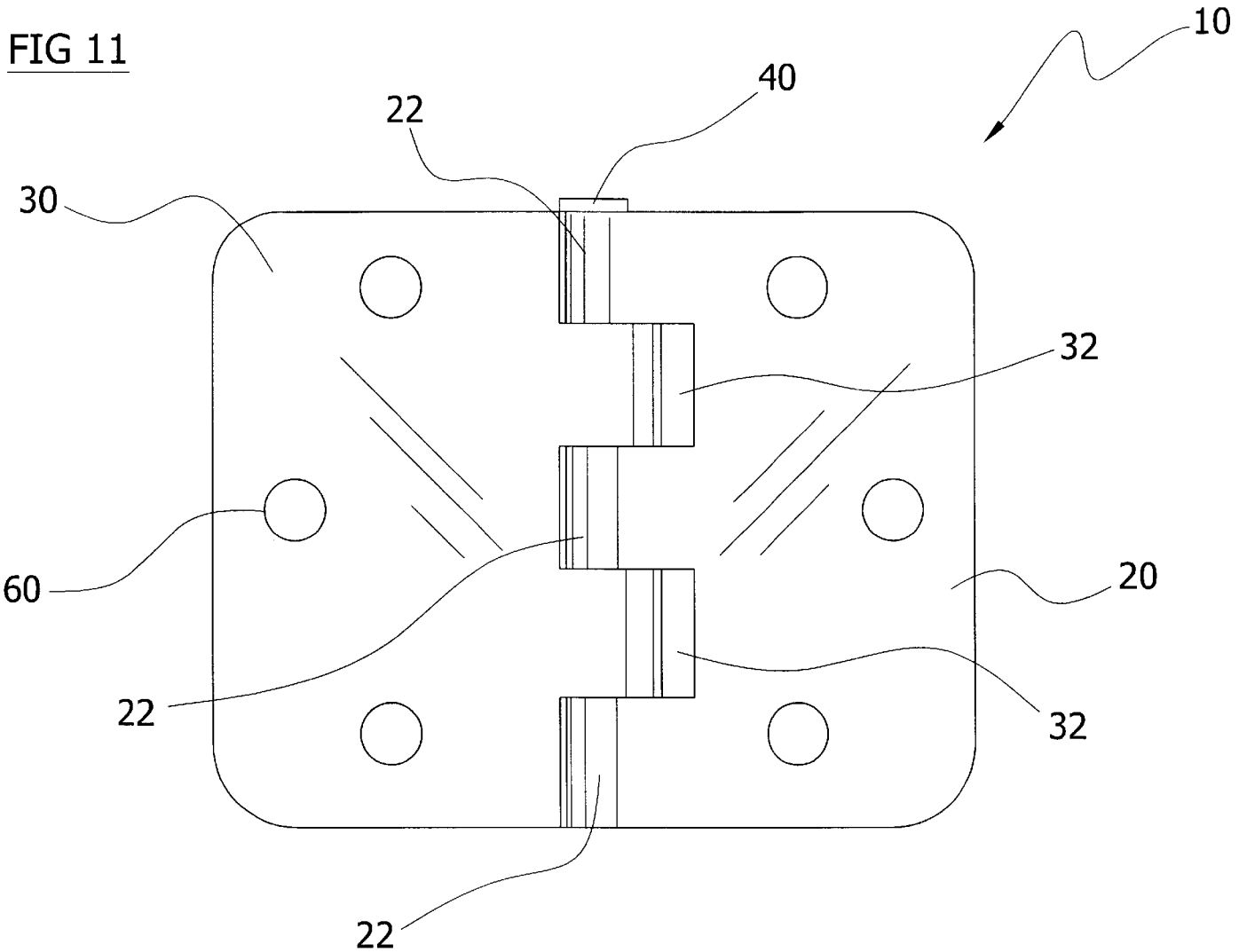
FIG. 11 is a side view of the alternative embodiment in the 180 degree open position.

A first alternative embodiment of the present invention is illustrated in FIGS. 8 through 11 of the drawings. The alternative embodiment allows for the door 12 to be opened into a 180 degree position as shown in FIGS. 8 and 11 of the drawings. The alternative embodiment utilizes the same structure as the main embodiment except that the extensions 22, 32 have a distal traverse portion as best illustrated in FIGS. 9 and 10 of the drawings. The distal traverse portion of the first extensions 22 are allowed to pass through openings within the second leaf 30 between the second extensions 32 thereby allowing the first leaf 20 to rotate approximately 180 degrees with respect to the second leaf 30 as best illustrated in FIG. 11 of the drawings. The locking pin 50 may be inserted to prevent the door 12 from rotating past 180 degrees and for preventing the door 12 from closing. When the leafs 20, 30 are closed with respect to one another they are substantially aligned with one another thereby aligning the respective apertures 24, 34 for receiving the locking pin 50 as shown in FIG. 10 of the drawings.

Figure 12:
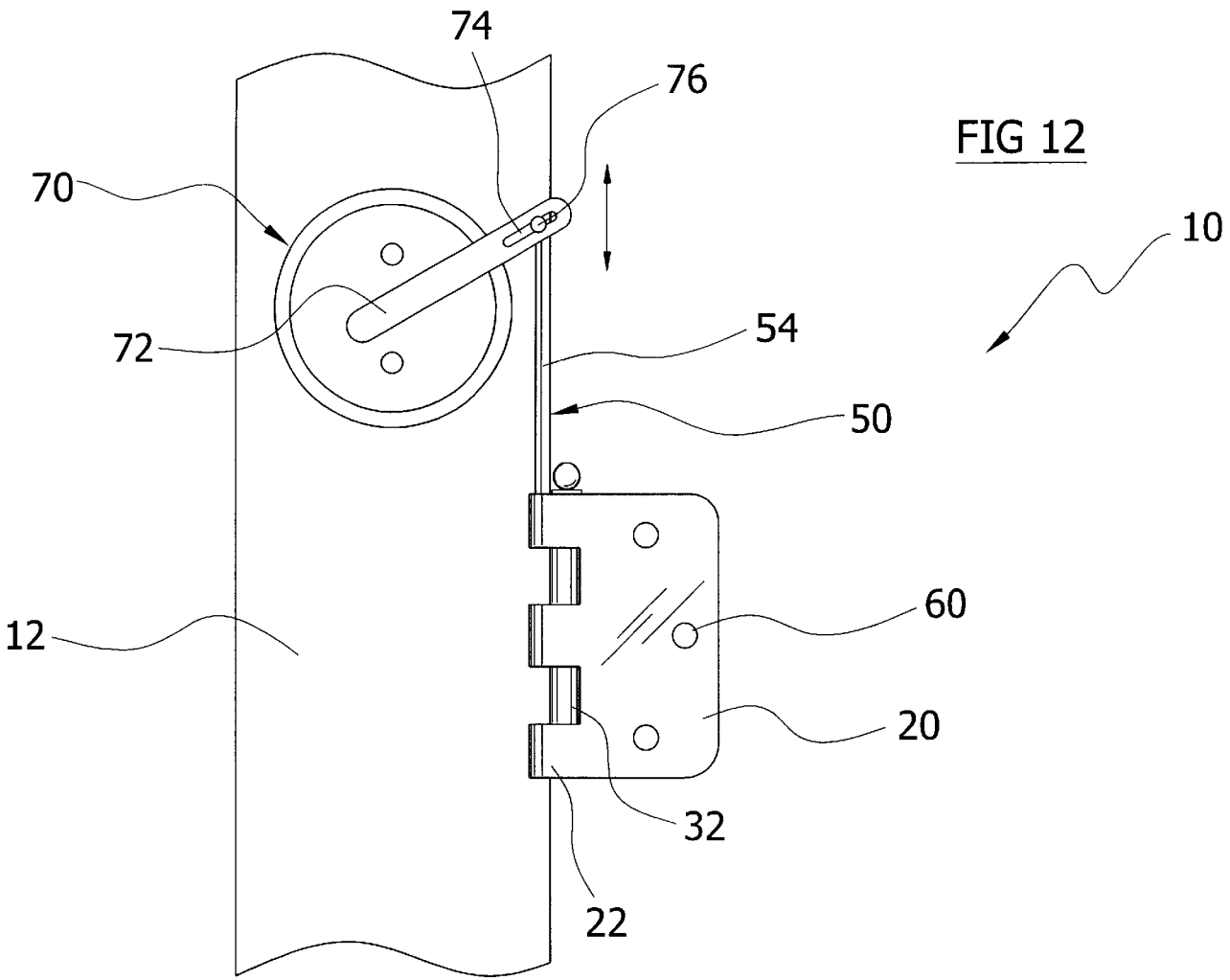
FIG. 12 is a side view of a second alternative embodiment of the present invention utilizing a locking mechanism.
Figure 13:
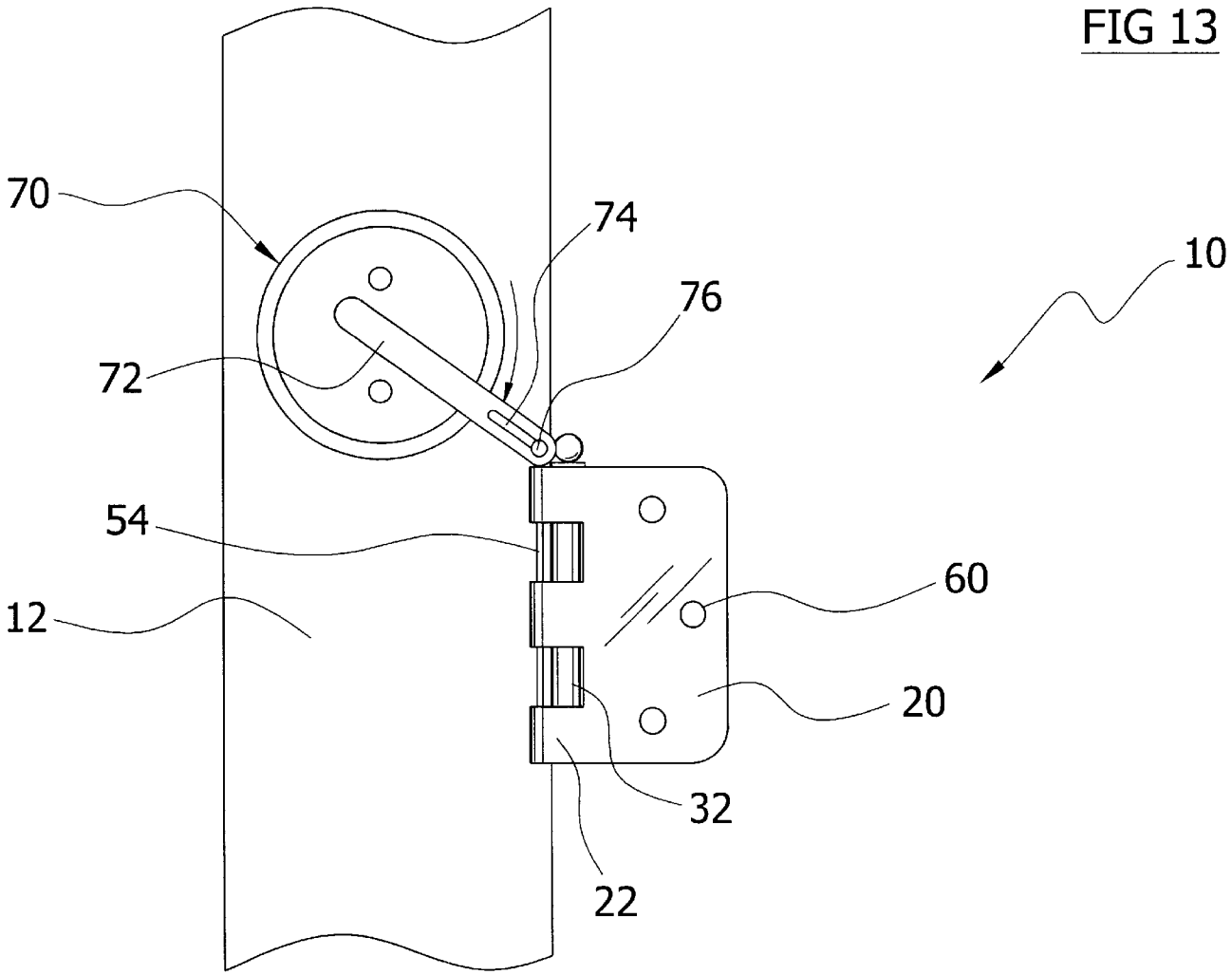
FIG. 13 is a side view of the second alternative embodiment with the locking mechanism inserting the locking pin.

A second alternative embodiment of the present invention is illustrated in FIGS. 12 and 13 of the drawings. The second alternative embodiment may be utilized with the main and first alternative embodiment of the present invention. The second alternative embodiment utilizing a locking mechanism 70 positioned within the door 12 adjacent the leafs 20, 30. A lever 72 having a slot 74 extends from the locking mechanism 70 and is connected to the locking pin 50 by a connecting pin 76 within the slot 74. The user utilizes a key or similar device to rotate the lever 72 while positioned outside of the door 12 thereby allowing the user to lock the locking hinge system 10 from the outside when the door 12 is closed. FIG. 13 illustrates the insertion of the locking pin 50 through the first extensions 22 when the leafs 20, 30 are in an open position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A locking hinge system, comprising:

a first leaf;

a plurality of first extensions extending from said first leaf;

first aperture extending through each of said first extensions along a common axis;

a second leaf pivotally attached to said first leaf;

a plurality of second extensions extending from said second leaf;

a second aperture extending through each of said second extensions along a common axis that is aligned with said first aperture when said first leaf and said second leaf are in a closed position; and a locking pin removably extendable through said first aperture and said second aperture of said first extensions and said second extensions respectively;

wherein said first extensions and said second extensions each include a center aperture, and a tubular pin positioned within said center aperture for pivotally attaching said first leaf and said second leaf to one another;

wherein said tubular pin has an upper opening exposing a lumen for removably receiving said locking pin.

2. The locking hinge system of claim 1, wherein said locking pin is comprised of an elongate shaft and a head secured to a distal end of said elongate shaft.

3. The locking hinge system of claim 1, wherein said first extensions extend substantially parallel from said first leaf, and wherein said second extensions extend substantially parallel from said second leaf.

4. A locking hinge system, comprising:

a first leaf;

a plurality of first extensions extending from said first leaf;

a first aperture extending through each of said first extensions along a common axis;

a second leaf pivotally attached to said first leaf;

a plurality of second extensions extending from said second leaf;

a second aperture extending through each of said second extensions along a common axis that is aligned with said first aperture when said first leaf and said second leaf are in a closed position; and a locking pin removably extendable through said first aperture and said second aperture of said first extensions and said second extensions respectively;

wherein said first extensions and said second extensions have a traverse distal portion;

wherein said second leaf includes a plurality of openings for allowing said first extensions to pass through when said first leaf is rotated greater than 90 degrees with respect to the second leaf;

wherein said first extensions and said second extensions each include a center aperture, and a tubular pin positioned within said center aperture for pivotally attaching said first leaf and said second leaf to one another;

wherein said tubular pin has an upper opening exposing a lumen for removably receiving said locking pin.

5. The locking hinge system of claim 4, wherein said locking pin is comprised of an elongate shaft and a head secured to a distal end of said elongate shaft.

6. A locking hinge system, comprising:

a first leaf;

a plurality of first extensions extending from said first leaf;

a first aperture extending through each of said first extensions along a common axis;

a second leaf pivotally attached to said first leaf;

a plurality of second extensions extending from said second leaf;

a second aperture extending through each of said second extensions along a common axis that is aligned with said first aperture when said first leaf and said second leaf are in a closed position;

a locking pin removably extendable through said first aperture and said second aperture of said first extensions and said second extensions respectively; and a locking mechanism mechanically connected to said locking pin for extending and removing said locking pin from said first aperture and said second aperture;

wherein said first extensions and said second extensions each include a center aperture, and a tubular pin positioned within said center aperture for pivotally attaching said first leaf and said second leaf to one another;

wherein said tubular pin has an upper opening exposing a lumen for removably receiving said locking pin.

7. The locking hinge system of claim 6, wherein said locking pin is comprised of an elongate shaft and a head secured to a distal end of said elongate shaft.

8. The locking hinge system of claim 6, wherein said first extensions extend substantially parallel from said first leaf, and wherein said second extensions extend substantially parallel from said second leaf.

9. The locking hinge system of claim 6, wherein said first extensions and said second extensions have a traverse distal portion.

10. The locking hinge system of claim 9, wherein said second leaf includes a plurality of openings for allowing said first extensions to pass through when said first leaf is rotated greater than 90 degrees with respect to the second leaf.

11. The locking hinge system of claim 10, wherein said first extensions and said second extensions each include a center aperture, and a tubular pin positioned within said center aperture for pivotally attaching said first leaf and said second leaf to one another.

12. The locking hinge system of claim 11, wherein said tubular pin has an upper opening exposing a lumen for removably receiving said locking pin.

13. The locking hinge system of claim 6, wherein said locking mechanism includes a lever, a slot within said lever, and a connecting pin positioned within said slot and secured to said locking pin.

* * * * *